United States Patent [19]

Armell et al.

[11] Patent Number: 4,964,460

[45] Date of Patent: Oct. 23, 1990

[54] SHUT-IN TOOL

[75] Inventors: Richard A. Armell; David Coull, both of Montrose, Scotland

[73] Assignee: Eljay Well Services Limited, Dundee, Scotland

[21] Appl. No.: 401,454

[22] PCT Filed: Jan. 16, 1989

[86] PCT No.: PCT/GB89/00036

§ 371 Date: Sep. 15, 1989

§ 102(e) Date: Sep. 15, 1989

[87] PCT Pub. No.: WO89/06740

PCT Pub. Date: Jul. 27, 1989

[30] Foreign Application Priority Data

Jan. 15, 1988 [GB] United Kingdom ..... 8800875

[51] Int. Cl.[5] ..... E21B 34/14; E21B 47/06; E21B 49/00; E21B 23/00

[52] U.S. Cl. ..... 166/113; 166/142; 166/240; 166/373; 166/385; 166/386

[58] Field of Search ..... 166/240, 250, 142, 143, 166/152, 385, 332, 386, 373, 113

[56] References Cited

U.S. PATENT DOCUMENTS

| | | | |
|---|---|---|---|
| 2,752,861 | 7/1956 | Hill | 166/106 |
| 4,108,243 | 8/1978 | King et al. | 166/66 |
| 4,583,592 | 4/1986 | Gazda et al. | 166/142 X |
| 4,678,035 | 7/1987 | Goldschild | 166/250 |
| 4,790,378 | 12/1988 | Montgomery et al. | 166/142 X |

FOREIGN PATENT DOCUMENTS

| | | |
|---|---|---|
| 0267096 | 5/1988 | European Pat. Off. . |
| 2609103 | 7/1988 | France . |
| 2102045 | 1/1983 | United Kingdom . |

*Primary Examiner*—Stephen J. Novosad
*Attorney, Agent, or Firm*—Leydig, Voit & Mayer

[57] ABSTRACT

A wire line operated shut-in tool for a tubing string of an oil or gas well has a locking mandrel for cooperation with a ported landing nipple disposed below a packer in the tubing string to lock the tool in position, and a mandrel core which passes through the locking mandrel and is axially movable relative thereto, the core having a lower portion which is surrounded by the locking mandrel and is caused to rotate by the engagement of pins projecting inwardly from the locking mandrel with a jay slot assembly machined on the outer surface of the core when the core is moved axially. The arrangement of the jay slot assembly is such that by operating the wire line to move the core axially relative to the locking mandrel, the tool can be cycled between respective positions in which the well can be flowed, the reservoir shut-in, or the tool run out of the well. A bore extends through the mandrel core so that reservoir pressure can be applied to a pressure gauge coupled to the tool when the tool is in the shut-in position.

20 Claims, 3 Drawing Sheets

SHUT-IN TOOL

The present invention relates to shut-in tools for use downhole in oil and gas wells in order to isolate or shut-in the reservoir from the surface to which it is connected via a tubing string. The use of such a tool to shut-in the reservoir allows reservoir pressure or other parameters to be measured as a function of time. The manner in which the pressure builds up when the oil or gas cannot escape provides useful information about the nature and capacity of the oil-bearing formation.

The value of such pressure measurements is well-known in the art and, therefore, various methods have been proposed for lowering the necessary pressure gauges downhole together with the necessary valve assembly to enable the reservoir to be shut-in. At least part of the required assembly is normally lowered into the tubing string via a wireline, which can provide electrical connections to the surface for the pressure gauges connected to the assembly. Since memory and mechanical gauges are also available for recording pressure variation with time, such an assembly may also be used with a slick wireline. Such an assembly is known as a shut-in tool. In order that repeated measurements may be made, without the need to raise the tool to the surface in between each measurement, it is desirable for the tool to provide not only for a shut-in position, but also for a flow position. Repeated measurements require that it should be possible to cycle the tool between its flow position and its shut-in position from the surface.

One existing proposal described in US-A- 4 678 035 (Schlumberger Technology Corporation) requires that a full-bore valve assembly be inserted into the tubing string. The actuator together with the pressure gauge is then lowered into the valve assembly on a wireline. This arrangement is known as the MUST (Trade Mark) configuration. The disadvantage of such an arrangement is that it is necessary to have a relatively complex valve assembly inserted permanently in the tubing string. This valve assembly incorporates moving parts, which may be subject to failure due to contamination by sand in the oil or gas being produced so that failure will inevitably occur. A primary technical problem is, therefore, the provision of a shut-in tool which allows any movable parts necessary for cycling between the shut-in and flow positions to be provided in a wireline retrievable tool, rather than in the tubing string.

A tubing string component known as a "landing nipple" has been proposed for incorporation into production tubing strings. Such nipples are used for landing safety valves or other wireline equipment. These landing nipples are designed to receive locking mandrels, which incorporate locking dogs mounted by means of double acting springs. These dogs are movable radially between retracted and expanded positions by means of an actuator sleeve, which is part of the locking mandrel. The sleeve moves axially downwardly when the locking mandrel engages against a no-go shoulder profile in the nipple, thereby causing the dogs to expand outwardly into a corresponding circumferential recess defined in the nipple wall. Such locking mandrels and their associated landing nipples are manufactured, for example, by Otis Engineering Corporation. The shut-in tool of the invention will be described for use with a no-go nipple. Alternative actuating techniques would be required for landing the tool in selective nipples above the no-go nipple. The skilled man will readily appreciate what necessary modifications may be made for using a selective nipple instead of a no-go nipple.

Landing nipples may also be manufactured with ports provided in an axially extending portion of the tubing string above the dog-receiving recess. Such a ported landing nipple is manufactured by AVA International as a standard component. This type of landing nipple is designed for incorporation permanently in the tubing string and is therefore resistant to damage by sand in the oil or gas. All moving parts to co-operate with such a landing nipple are provided on the locking mandrel which co-operates with it and which is wireline retrievable.

The technical problem of the present invention is therefore to provide a shut-in tool which is capable of co-operation with a ported landing nipple that can readily be permanently or temporarily incorporated into a tubing string, and which tool provides for multiple recycling between shut-in and flow positions, as well as for retrieval in a reliable manner.

The present invention accordingly provides a shut-in tool for co-operation with a ported landing nipple disposed below a packer in a tubing string of an oil or gas well, the ported landing nipple defining upper and lower interior seal bores above and below ports thereof, said tool comprising

- a locking mandrel for co-operation with the landing nipple,
- a mandrel core comprising upper and lower, relatively rotatable portions, the core defining a through bore, said locking mandrel surrounding the lower portion of the core, said upper portion of the core defining
  - a packing assembly, sealingly engagable with said interior seal bores of the nipple,
  - coupling means for receiving a test gauge such that the gauge is in fluid communication with the interior of the tubing string,
  - an equalizing valve assembly moveable between a closed position in which fluid communication between the through bore and the interior of the tubing string above the packing assembly is prevented, and an open position in which said fluid communication is allowed, and
  - means for connecting the tool to a wireline,
- jay slot means comprising a pattern of grooves and at least one pin engageable therein, the pattern being defined on the lower portion of the core or in a co-operating surface of the locking mandrel and the pin being carried by the other of these parts,
- the pattern of grooves being such that, in response to axial movement, the lower portion of the core is guided rotationally and axially relative to the upper portion in order to cycle the tool between a flow position and a shut-in position.

The tool of the present invention is advantageous in that it contains few moving parts. Preferably a bearing between the core portions is provided in the packing assembly and is protected from oil or gas flow by means of seals, for example wiper seals to provide a debris barrier. The arrangement requires no hinged flaps either in the tubing string or in the tool itself. The only springs used are those in the locking mandrel, and these can readily be protected from the flow of oil or gas from both above and below by the design of the mandrel and its actuating sleeve. The operation of the tool can be effectively controlled by regulating the tension in the wireline in a simple manner.

Further features and advantages of the reservoir shut-in tool of the invention will be apparent from a description of the preferred embodiment of the tool which will now be described, by way of example only, with reference to the accompanying diagrammatic drawings, in which.

Figure 1:
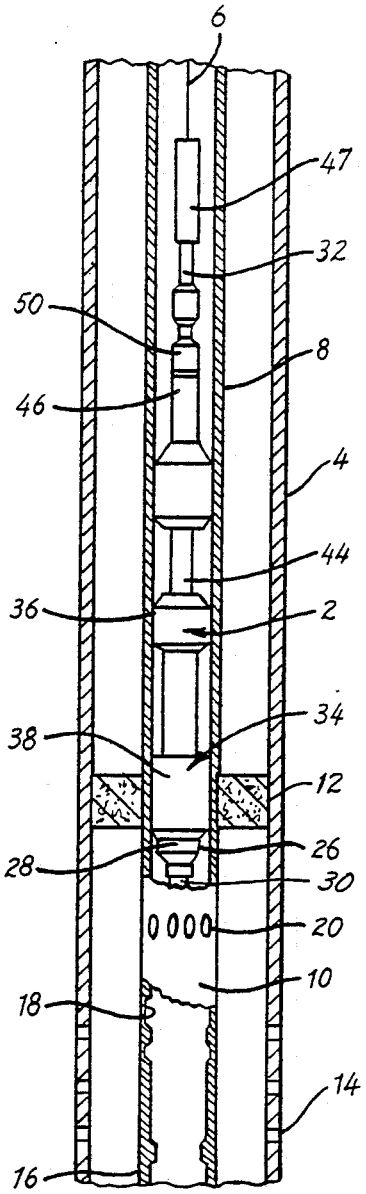
FIG. 1 shows the reservoir shut-in tool being run into a tubing of an oil or gas well.

The reservoir shut-in tool 2 is intended to be run into and out of an oil or gas well 4 on a wireline 6. The tool runs in through the tubing string 8 of the well. The tubing string incorporates a ported landing nipple 10 which is positioned below a packer 12, which isolates the annular space between the interior of the well casing and the exterior of the tubing string from the producing reservoir. The casing of the oil or gas well 4 is shown perforated at 14 to indicate that oil or gas from the producing formations surrounding the well can enter the interior of the casing below the packer 12. The ported landing nipple 10 incorporates a no-go shoulder profile 16, which prevents the tool 2 passing out of the tubing string 8 when it has reached the correct landing position. The nipple also incorporates a circumferential recess 18 which has a profile adapted to engage with that of locking dogs provided on the tool. The nipple is provided with ports 20 which allow oil or gas to flow from the well into the interior of the tubing string. Above and below these ports 20 the interior of the nipple has upper and lower seal bores 22, 24.

This type of ported landing nipple 10 is of essentially conventional design and may be fabricated as a unit or be made up of two or more conventional tubing string sections which are interconnected by a screw threaded coupling. For example the section containing the no-go shoulder profile 16 and circumferential recess 18 may be a type XN landing nipple as manufactured by Otis Engineering Corporation. The remaining section of the landing nipple incorporates the seal bores 22,24 and the ports 20.

The tool 2 comprises a central mandrel core 26 which extends the whole length of the tool and has a continuous central bore through which oil or gas can flow from the reservoir to a gauge mounted to the top of the tool. At the lower end of the core 26 the bore communicates with the exterior via ports 28. An exterior communication is also possible with the central bore further up as is described later. Both the lower and upper ends of the mandrel core 26 are provided with means whereby pressure gauges 30, 32 may be coupled to the tool. For example these means may be screw threaded sockets. Any gauge 30 connected to the lower end of the tool can measure pressure or another parameter in the reservoir below the packer. This gauge is not in communication with the central bore. The upper gauge 32 is in communication with the upper end of the bore that extends through the mandrel core. The upper portion of the tool is also provided with a connector for the wireline 6.

A conventional locking mandrel 34 surrounds a lower part of the mandrel core. The locking mandrel 34 allows the tool to be locked into position in the nipple 10, once the tool has been landed. This locking mandrel comprises an actuating sleeve 36, which is axially movable within an outer sleeve 38 which carries at least two locking dogs 40 (FIG. 2), which, when actuated by the sleeve 36, engage in the recess 18. The number of locking dogs used depends on the size of the mandrel.

The mandrel core 26 projects out of the lock-in mandrel 34 and incorporates a larger diameter packing assembly 42. This packing assembly marks the junction between a lower portion 44 of the core and an upper portion 46. These portions are relatively rotatable and a needle bearing (FIG. 2) is provided in the interior of the packing assembly 42 to permit such relative rotation. In the upper end of the upper portion of the core there is an equalizing valve assembly 50, which is made up of a piston which is axially slidable in a sleeve section of the core, in order to open and close the valve . The upper core portion 46 provides the means whereby a gauge 32 and the wireline 6 may be coupled to the tool.

Figure 2:
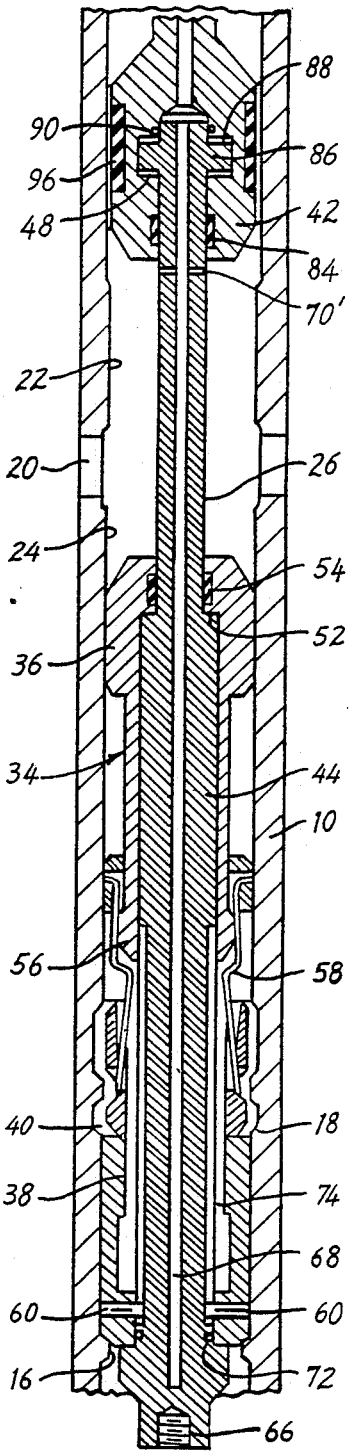
FIG. 2 is a longitudinal section through a lower portion of the tool showing it in its release or running in or out position having just landed in the nipple.
Figure 3:
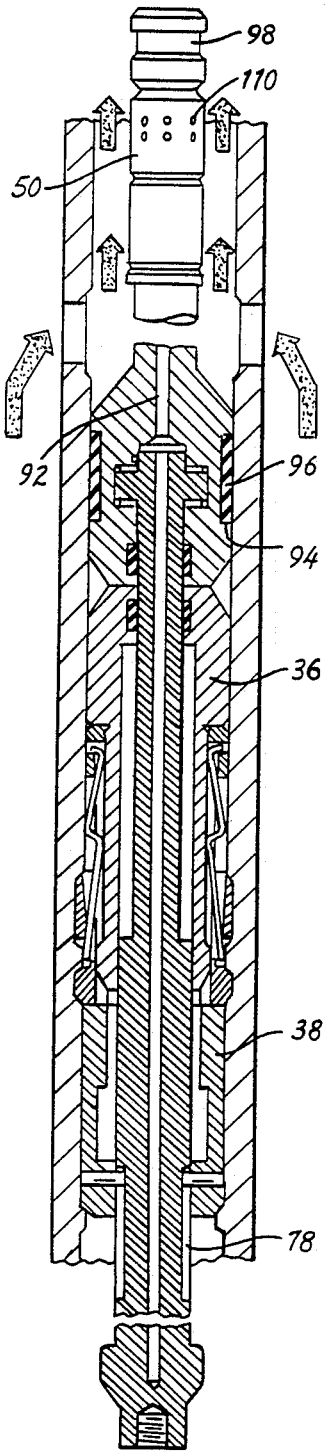
FIG. 3 is a longitudinal section, with parts broken away, showing the tool in its flow position.
Figure 4:
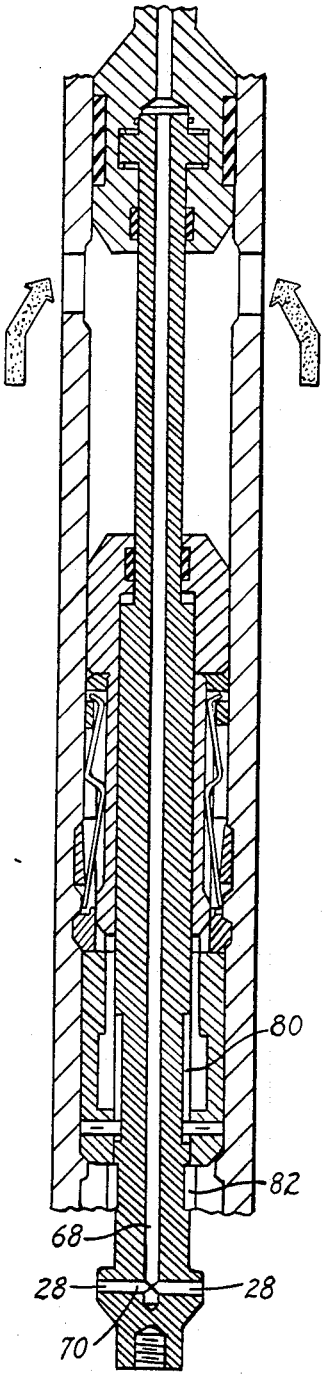
FIG. 4 is a longitudinal section through a lower part of the tool showing it in its shut-in position.

The tool, as described in outline above, is capable of being set into four different operating positions, a release position in which the tool can be run into and out of the tubing string as shown in FIG. 1 and 2, a flow position, as shown in FIG. 3, where the oil or gas well can be flowed despite the presence of the tool, a shut-in position, as shown in FIG. 4, in which the reservoir below the packer 12 can be isolated from the tubing string to prevent any oil or gas flowing out of the well, and an equalise position similar to the flow position of FIG. 3. The tool can be cycled indefinitely between these positions solely by regulating the tension in the wireline 6 by pulling or relaxing it to compensate for the weight of the toolstring and of any weight bar payloads 47 carried. This can be achieved by control of the wireline from the surface. For example release of tension in the wireline allows the weight bars 47 to apply a downward force on the tool.

The various components of the tool will now be described in more detail with reference to FIGS. 2–7.

The locking mandrel 34 which surrounds the lower portion 44 of the mandrel core 26 is of essentially conventional design and will not be described in great detail. The actuating sleeve 36 surrounds the lower portion 44 of the mandrel core just above a shoulder 52 which limits the upward axial movement of the lower core portion 44 relative to the actuating sleeve. As shown in FIG. 2 the shoulder 52 and the sleeve 36 are in engagement in the running in and out position of the tool. A wiper seal 54 provides a debris barrier and a bearing between the actuating sleeve and the core portion 44. The actuating sleeve 36 carries depending lugs 56 which engage behind double acting springs 58 which carry the locking dogs 40 in the outer sleeve 38 of the locking mandrel. Relative axial movement between the two sleeves 36 and 38 causes the lugs to pass down behind the springs 58 forcing the dogs outwardly into the corresponding recess 18 in the locking nipple. Release of the dogs can only be achieved by raising the actuating sleeve 36. An upward force can only be applied to the actuating sleeve 36 by means of the shoulder 52 on the core portion, since only the core is coupled to the wireline. Therefore, inadvertent release of the locking mechanism can be prevented by preventing engagement between the shoulder 52 and the actuating sleeve 36.

Figure 7:
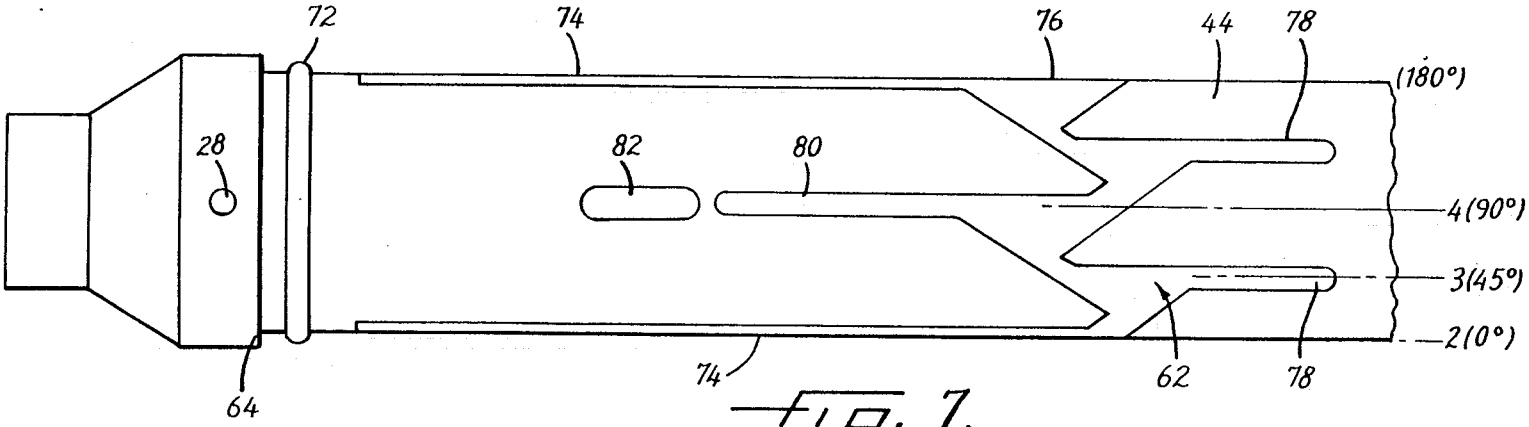
FIG. 7 is an exterior view of the end of the lower portion of the mandrel core illustrating the jay slot assembly.

The locking mandrel as so far described is essentially conventional. For the purposes of the present invention a modification is made to the outer sleeve 38 by the provision of two, diametrically opposed, inwardly projecting pins 60. These pins 60 engage in grooves of a jay slot assembly 62 cut into the outer surface of the lower portion of the mandrel core. The jay slot assembly 62 is best illustrated in FIG. 7 and will be described further later.

When the locking mandrel is actuated, this mandrel is non-rotatably secured in the tubing string 8 by means of the tight frictional engagement between the locking dogs and the profile of the recess 18. Therefore, the pins 60 are used in conjunction with the jay slot assembly 62 to control axial and rotational motion of the mandrel core relative to the locking mandrel and tubing string in response to wireline tension.

The lower edge of the outer sleeve 38 is shaped to engage with the no-go shoulder profile 16 when the tool has been landed in the nipple. The opening through which the mandrel core passes in the lower end of the locking mandrel is assymetric and is slightly narrower in the dimension shown in FIGS. 2, 3 and 4 than in the perpendicular dimension. The purpose of this is to allow the mandrel core to pass up into the locking mandrel in one orientation only.

The lower portion 44 of the mandrel core has, at its lower end, an enlarged section which defines a shoulder 64 which limits the axial upward movement of the core relative to the locking mandrel. The enlarged section also defines a socket 66 for receiving a gauge 30. Although for most applications such a gauge 30 will be a pressure gauge, this is not essential and the tool can be used to carry any gauge required to make test measurements of the conditions in the reservoir below the packer. Such a gauge will normally be a memory or mechanical gauge.

The central through bore is represented by an axially extending bore 68 in the lower portion 44. This bore 68 joins a transverse bore 70 (FIG. 4) which opens to the exterior at the ports 28 to allow pressure from the reservoir to enter the central bore. An 0-ring seal 72 surrounds the core portion just above the shoulder 64. This seal 72 provides a frictional engagement with the facing, inner wall of the outer sleeve 38 of the locking mandrel. This frictional engagement is enough to maintain the core 44 and the locking mandrel in the relative position shown in FIG. 2 while the tool is being run into or out of the well. In this way premature actuation of the locking dogs is prevented.

A jay slot assembly 62 of grooves is cut into the outer surface of the core. The width of the grooves is such that the ends of the pins 60 are received therein in order to guide the core in relative axial and rotational motion. A 180° portion of the jay slot assembly 62 is illustrated in FIG. 7 and this pattern is repeated around the whole periphery of the core. In each of the running, flow, or shut in positions, the core portion 44 is in a different rotational orientation relative to the locking mandrel. These relative positions are indicated by the section lines, 2, 3 and 4 shown in FIG. 7 which indicate the positions of the core portion 44 in FIGS. 2, 3 and 4 respectively. The jay slot assembly comprises two opposed grooves 74 which extend from just above the 0-ring seal 72 axially upwardly to a section 76 of the assembly which defines a zig-zag belt around the entire periphery of the core portion 44. In order to facilitate reference to positions around this belt one of the grooves 74 will be defined as the 0° position. The other groove 74 is therefore at the 180° position. Because of the symmetry of the pattern it is not necessary to distinguish between these grooves 74. At 90° intervals, four grooves 78 extend upwardly from the zig-zag belt section 76. These grooves 78 are at the 45°, 135°, 225° and 315° positions. The pins 60 are received in the grooves 78 at 45° and 225° when the core is in its flow position as shown in FIG. 3, and the grooves at the 135° and 315° positions where the core is in the equalise position. Two diametrically opposed grooves 80 extend downwardly form the zig-zag belt section 76. These grooves 80 are at the 90° and 270° position. Each groove 80 terminates just above a projecting key 82. In the shut-in position as shown in FIG. 4 these keys 82 engage with the edge of the assymetrical opening in the outer sleeve 38 of the locking mandrel. The opening in the interior of the outer sleeve of the locking mandrel is shaped so that the keys 82 will pass into the sleeve when aligned as shown in FIG. 2 but not when as aligned as shown in FIG. 4.

At its upper end the lower core portion 44 enters the packing assembly 42. An axial debris barrier 84 is positioned between the core portion 44 and the interior of the packing assembly to prevent debris travelling along the outer surface of the core portion into the needle bearing 48. An annular flange 86 projects from the core 44 and is engaged in a corresponding recess 88 in the packing assembly. Rollers are received between the engaging surfaces of the recess and flange in order to define the needle bearing 48.

In a modification of the tool, the central bore 68 does not need to extend the entire length of the core portion 44 but may extend only from its opening in the upper face of this portion to a point just below where the portion 44 enters the packing assembly 42. At this point the bore 68 may join a transverse bore 70', shown only in FIG. 2. With this modification the gauge 32 which is in communication with the upper end of the central bore, is in communication with the reservoir pressure at all times through the central bore and equalizing assembly 50.

The upper portion 46 of the mandrel core defines the upper portion 92 of the central bore of the tool. This bore 92 opens into the space above the recess 88 to provide communication with the bore 68. The packing assembly, which defines the lower end of the portion 46 has an annular peripheral recess 94 into which chevron seals 96 are packed to provide a seal between the exterior of the packing assembly and the seal bores 22,24 of the landing nipple.

Figure 6:
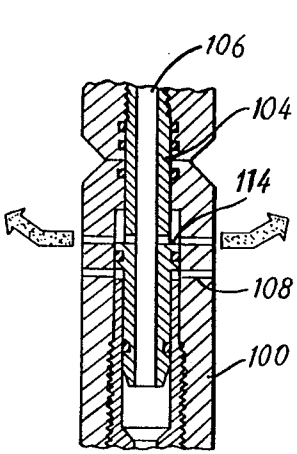
FIG. 6 is a longitudinal section through the equalizing valve assembly of FIG. 5 showing it in its open position.
Figure 5:
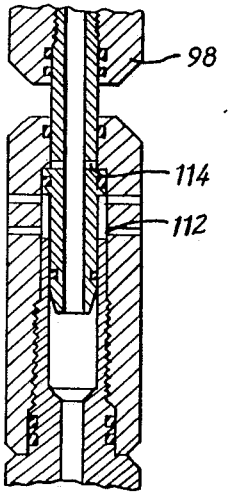
FIG. 5 is a longitudinal section through the equalizing valve assembly in the upper portion of the core showing it, in its closed position.

The upper portion 46 of the mandrel core incorporates the equalizing valve assembly shown in detail in FIGS. 5 and 6 and terminates in a socket 98 by means of which a pressure gauge 32 can be coupled to the tool in communication with the bore 92. The socket 98 also provides means whereby the wireline 6 may be connected to the tool. The socket 98 may be a threaded socket or other device known for this purpose.

The equalizing valve assembly 50 in the upper portion of the mandrel core is made up of an annular sleeve 100 which is formed as a separate member and which is screw threaded to an elongate member 102 which projects from the packing assembly 42. The sleeve 100 defines a socket into which the bore 92 opens and which defines a cylinder in which a piston 104 connected to the remainder of the upper portion of the core, in particular the socket 98, is axially slidable. This piston 104 has a bore 106 extending through it. The bore 106 together with the bore 92 and the bore 68 make up the central bore through the mandrel core. The bore 92 is in permanent communication with the bore 106. A number of transverse bores 108 extend in two axially spaced tiers through the wall of the sleeve 100 to ports 110 opening to the exterior of the tool (FIG. 3). An annular recess 112, of sufficient axial length to bridge the axially spaced pairs of bores 108 in the closed position of the valve, is formed in the periphery of the piston 104. Above this recess 112 a number of transverse bores 114 extend from the bore 106 to the periphery of the piston and in the open position of the valve, make contact with the inner ends of the transverse bores 108 so that oil or gas from the bore 92 can flow into the bore 106 in the piston, through these transverse bores 114 into the bores 108 and out of the tool into the interior of the tubing string. This open position of the valve assembly 50 is illustrated in FIG. 6. In the open position, therefore, the oil or gas pressure on either side of the packing assembly 42 can be equalized in order to allow the assembly to be moved as a preparatory measure to recyling the tool from the shut-in to the flow position. The open position of the valve assembly is defined when the socket 98 seats directly against the upper surface of the sleeve 100. The closed position is defined when a shoulder 114 on the piston moves into engagement with a corresponding shoulder at the top of the sleeve. Seals are provided between the member 102 and the sleeve, and between the piston and the internal wall of the sleeve above and below the recess 112, as well as between the abutting surfaces of the piston 104 and the upper part of the sleeve and the lower part of the socket respectively. These seals serve to exclude oil or gas and also those abutting the piston facilitate the axial motion of the piston.

In a further modification (not illustrated) the jay slot assembly could be formed on the internal surface of the locking mandrel and the pin or pins be provided as projections from the core.

The operation of the tool will now be described.

When the tool is in its release or running position, in which it is run into or out of the tubing string, the lower portion of the mandrel core is frictionally engaged in the lower part of the outer sleeve of the locking mandrel by means of the 0-ring seal 72. The pins 60 are positioned at the lower ends of the grooves 74 in the 0° and 180° positions. The locking mandrel is in its non-actuated position with the actuating sleeve out of engagement with the outer sleeve as shown in FIG. 2. The equalizing valve assembly is in its closed position due to the weight of the tool pulling the sleeve 100 downwardly against the shoulder 114 of the piston.

In this position, the tool is lowered on the wireline 6 until the base of the outer sleeve of the locking mandrel comes into engagement with the no-go profile 16 of the ported locking nipple. When this happens the momentum of the tool and tool string will normally be sufficient to overcome the frictional engagement provided by the 0-ring seal 72, thereby allowing the mandrel core to carry on moving downwardly guided by the engagement of the pins 60 in the grooves 74. Continued downward movement of the central core causes the lower shoulder of the packing assembly 42 to engage the actuating sleeve 36, the downward motion of which causes the lugs 56 to actuate the locking dogs locking the mandrel and, therefore, the tool into the tubing string. As the pins 60 move relatively "up" the grooves 74 to the zig-zag belt section they engage the upwardly inclined edge of the belt section immediately above the upper ends of grooves 74 and are diverted into the adjacent grooves 78 so that the tool moves into the flow position as shown in FIG. 3 with the pins in the 45° and 225° positions.

The locking mandrel and the core portions are longitudinally dimensioned so that the lower surface of the packing assembly comes to rest on the upper surface of the locking mandrel just before the pins 60 reach the top of their groove 78, thus preventing the weight of the mandrel core being transmitted to the pins 60.

In the flow position illustrated in FIG. 3 oil or gas can flow through the ports 20 as shown by the broad arrows, and up through the tubing string around the upper portion of the mandrel core . Oil or gas can also flow through the ports 28 into the central bore and out through the ports 110 of the equalizing valve member, which has now collapsed into its open position under the action of downward force from the weight bars 47. The total flow area through the ports 20 and around the upper part of the tool as well as through the central bore is designed to be as close as possible to the flow area without the tool present in order to minimize any choking effect due to the presence of the tool. For this reason, the diameter of the upper part of the tool above the packing assembly should be as small as possible.

In order to move the tool into its shut-in position as shown in FIG. 4, the operator at the surface applies a controlled tension to the wireline 6. This has the effect of pulling the whole mandrel core upwardly relative to the locking mandrel which is fixed in the tubing string. The lower portion 44 of the mandrel core is guided by the engagement of the pins 60 in the groove 78. As the pins reach the zig-zag belt section they engage an inclined edge which diverts them laterally into the grooves 80. As this occurs, the lower core portion 44 rotates in its needle bearings relative to the packing assembly 42 of the upper core portion. The upward motion of the mandrel core is stopped when the keys 82 engage with the lower surface of the outer sleeve 38 of the locking mandrel. In this shut-in position the pins 60 are at the 90° and 270° positions. In these positions the pins 60 are stopped just short of the base of the grooves 80. In this way excessive wear of the pins and grooves is prevented. The pins are also not subject to the forces that pressure build up in the shut-in well creates. When the keys 82 engage with the locking mandrel the packing assembly 42 is engaged in the upper seal bore 22 above the ports 20. The chevron seals 96 make a pressure-tight seal between the seal bore and the tool so that oil or gas from the reservoir can now no longer enter the tubing string to flow out of the well. During shut-in, a sufficient tension is applied to the wireline in order to maintain the equalizing valve assembly in the closed position. Therefore, in the shut-in position oil or gas pressure which passes from the reservoir through ports 28 into the central bore is communicated only to the gauge fitted into the socket 98 of the tool and cannot escape from the reservoir. Therefore the pressure build-up with time following shut-in can be recorded in order to obtain information about the characteristics of the producing formations.

In order to cycle the tool from the shut-in position to the equalise position, the tension in the wireline 6 is relaxed therefore allowing the weight of the toolstring and weight bar payload 47 to act downwardly. This initially causes the equalizing valve assembly 50 to open allowing oil or gas from the reservoir to pass through the central bore and out into the tubing string above the packing assembly 42. After a time interval, the pressure on each side of the packing assembly will be equalized so that the packing assembly can be moved downwardly under the influence of negative wireline tension out of its sealing engagement with the seal bore 22. The downward motion is, once again, guided by the pins 60 moving relatively upwardly in the grooves 80 until they strike the inclined surface of the zig-zag belt section causing them to be diverted towards the next groove section 78. At this time the lower core portion rotates in the needle bearing relative to the upper core portion and the tool will adopt a position corresponding to that indicated in FIG. 3 when the packing assembly comes to rest on the top of the locking mandrel. In this equalise position in which flow can take place the pins 60 are at the 135° and 315° positions.

The next time tension is applied to the wireline, the engagement of the pins in the jay slot assembly will bring the pins into line with the long grooves 74. If a strong pull is applied at this time, the tool can be removed from the well. If it is not desired to remove the tool but to cycle it back to its next shut-in position the wireline is pulled with sufficient tension to allow the pins to move down into the zig-zag belt assembly, but not sufficient to pull the core beyond that. The tension in the wireline is relaxed to allow the pins to move back into the flow grooves 78 and, from there, as previously described, the shut-in position can once again be achieved when required. The tool can be indefinitely cycled in this way until it is desired to remove it.

We claim:

1. A shut-in tool for cooperation with a ported landing nipple disposed below a packer in a tubing string of an oil or gas well, the ported landing nipple defining upper and lower interior seal bores above and below ports thereof, said tool comprising a locking mandrel for cooperation with the landing nipple, a mandrel core which is axially movable relative to the locking mandrel and comprises upper and lower portions, the lower portion being surrounded by the locking mandrel, and said mandrel core defining a through passage extending along at least part of the length of the core, jay slot means comprising a pattern of grooves and at least one pin engageable therein, the pattern being defined on the lower portion of the core or in a cooperating surface of the locking mandrel and the pin or pins being carried by other of these parts, said pattern of grooves being such that, in response to axial movement of the core relative to the locking mandrel, the lower portion of the core is guided rotationally and axially by engagement of the pin or pins with the grooves in order to cycle the tool between a flow position and a shut-in position, said upper portion of the mandrel core including a packing assembly sealingly engageable with said upper and lower interior seal bores of the landing nipple when the tool is in the shut-in and flow positions respectively, coupling means for receiving a test gauge such that the gauge will be in communication, via the through passage, with the pressure in the tubing string below the packing assembly when the tool is in the shut-in position, an equalizing valve assembly moveable between a closed position in which fluid communication between the through passage and the interior of the tubing string above the packing assembly is prevented, and an open position in which such fluid communication is allowed, and means for connecting the tool to a wireline.

2. A shut-in tool according to claim 1, in which the lower portion of the mandrel core is rotatable relative to the upper portion thereof.

3. A shut-in tool according to claim 2 in which the upper end of the lower portion is rotatably mounted within a bearing housed within the packing assembly of the upper portion.

4. A shut-in tool according to claim 1, in which the locking mandrel comprises an actuating sleeve which is axially moveable into an outer sleeve to force at least two locking dogs carried by the outer sleeve radially outwards to engage in a recess of the landing nipple to lock the mandrel in position in the nipple.

5. A shut-in tool according to claim 1, in which appropriate axial movement of the mandrel core relative to the locking mandrel is operative to operate the locking mandrel, and the pattern of grooves of the jay slot means is such that the tool can also be cycled, in response to axial movement of the core, to a running position in which the locking mandrel is disengaged from the landing nipple to permit retrieval of the tool.

6. A shut-in tool according to claim 5, in which the pattern of grooves comprises a series of axially extending, circumferentially spaced grooves in which successive grooves extend in opposite directions from a circumferential zig-zag section arranged so that each time the core is moved axially to bring the pin or pins into engagement with the zig-zag section, the lower portion of the core is rotated so that the pin or pins move into the next oppositely directed axially extending groove.

7. A shut-in tool according to claim 6, in which the grooves extending axially upwards from the zig-zag section define flow positions of the tool.

8. A shut-in tool according to claim 6 or claim 7, in which the grooves extending axially downwards from the zig-zag section alternately define running and shut-in positions.

9. A shut-in tool according to claim 6, in which the axially extending grooves are circumferentially spaced at 45° intervals.

10. A shut-in tool according to claim 6, in which the mandrel core includes stop means which engages the locking mandrel before the pin or pins reach the upper or lower ends of the upwardly extending or downwardly extending slots respectively.

11. A shut-in tool according to claim 10, in which the stop means for preventing the pin or pins reaching the upper ends of the upwardly extending slot defining flow positions is formed by the lower end of the packing assembly.

12. A shut-in tool according to claim 10 or claim 11, in which the stop means for preventing the pin or pins reaching the lower ends of the downwardly extending slots defining shut-in positions is defined by keys carried by the core in alignment with said slots and arranged to engage the lower end of the locking mandrel.

13. A shut-in tool according to claim 12, in which the stop means for preventing the pin or pins reaching the lower ends of the downwardly extending slots defining running positions is formed by an annular shoulder on the core arranged to engage the lower end of the locking mandrel, the shoulder being located below the keys, and the lower end of the mandrel being shaped to allow the keys to pass when the core is rotated into a running position.

14. A shut-in tool according to claim 1, in which there are two pins located diametrically opposite each other on the locking mandrel.

15. A shut-in tool according to claim 1, in which the equalizing valve assembly comprises a piston member and a sleeve member of the core in which the piston member is axially slideable between the open and closed positions, the open position being defined when the piston and sleeve members are moved axially together.

16. A shut-in tool according to claim 15, in which radial ports in the piston member communicate with radial ports in the sleeve member in the open position to communicate the through passage with the exterior of the core.

17. A shut-in tool according to claim 15 or claim 16, in which the piston member is formed integrally with the coupling means for receiving the test gauge.

18. A shut-in tool according to claim 1, in which the through passage extends axially through the core from the gauge coupling means at the upper end to a transverse, radially opening port near the lower end of the core.

19. A shut-in tool according to claim 1, in which the through passage extends axially through the core from the gauge coupling means at the upper end to a transverse, radially opening port located just below the packing assembly.

20. A shut-in tool according to claim 1, in which the core includes a further coupling for receiving a test gauge at the lower end of the core.

* * * * *

UNITED STATES PATENT AND TRADEMARK OFFICE

CERTIFICATE OF CORRECTION

PATENT NO. : 4,964,460

DATED : October 23, 1990

INVENTOR(S) : Armell et al.

It is certified that error appears in the above-identified patent and that said Letters Patent is hereby corrected as shown below:

On the Cover Page [73] Assignee:

The name of the first assignee has been omitted, please insert -- Drexel Equipment (U.K.) Limited, London, England --. ( Part Interest)

Signed and Sealed this

Nineteenth Day of January, 1993

*Attest:*

DOUGLAS B. COMER

*Attesting Officer*

*Acting Commissioner of Patents and Trademarks*